US005469677A

United States Patent [19]

Lüthi

[11] Patent Number: 5,469,677

[45] Date of Patent: Nov. 28, 1995

[54] STRESSING ANCHORAGE FOR AT LEAST ONE TENSION ELEMENT RUNNING INSIDE AN ENCASING TUBE AND METHOD OF PRODUCING THE STRESSING ANCHORAGE

[75] Inventor: Kurt Lüthi, Gwatt, Switzerland

[73] Assignee: VSL International AG, Switzerland

[21] Appl. No.: 180,144

[22] Filed: Jan. 11, 1994

[30] Foreign Application Priority Data

Jan. 11, 1993 [EP] European Pat. Off. ..... 93810009

[51] Int. Cl.[6] ..... E04C 3/10

[52] U.S. Cl. ..... 52/223.13; 52/223.14; 264/228; 24/122.6

[58] Field of Search ..... 52/223.13, 223.14, 52/223.1; 24/122.6, 136 R; 264/228

[56] References Cited

U.S. PATENT DOCUMENTS

| | | | |
|---|---|---|---|
| 3,520,032 | 7/1970 | Howlett et al. | 52/223.13 X |
| 3,921,353 | 11/1975 | Howlett et al. | 52/223.13 |
| 4,053,974 | 10/1977 | Howlett et al. | 264/228 X |
| 4,367,568 | 1/1983 | Weiser | 24/122.6 |
| 4,442,646 | 4/1984 | Prevedini | 52/223.13 |
| 4,454,633 | 6/1984 | de la Fuente et al. | 24/122.6 X |
| 4,619,088 | 10/1986 | Garcia-Mansilla | 52/223.13 |
| 4,628,649 | 12/1986 | Jartoux | 24/122.6 X |
| 4,640,068 | 2/1987 | Jungwirth et al. | 24/122.6 X |
| 4,719,658 | 1/1988 | Kriofske | 52/223.13 |
| 4,744,691 | 5/1988 | Thal | 24/136 R X |
| 4,819,393 | 4/1989 | Augoyard | 52/223.13 |
| 5,081,811 | 1/1992 | Sasaki | 52/223.13 |
| 5,345,742 | 9/1994 | Rogowsky et al. | 52/223.13 X |

*Primary Examiner*—Carl D. Friedman
*Assistant Examiner*—Beth A. Aubrey
*Attorney, Agent, or Firm*—Oldham & Oldham Co.

[57] ABSTRACT

For a stressing anchorage for a tension element running inside an encasing tube, a bearing plate with an annular opening is set up on an outer wall of a structural part. In an area of the opening turned away from the structural part there is a cone opening outward. A trumpet of plastic is bonded to the encasing tube, likewise of plastic, at its end situated in the structural part. The outer end of the trumpet is more or less flush with the face of the bearing plate turned away from the structural part. A transition piece projects into the trumpet with a projection leading in whose surface area is shaped frustoconically. Owing to the truncated cone, the outer end of the trumpet is pressed against the cone of the bearing plate, and is held firmly in an annular gap between the said truncated cone and the said cone after the anchor head is placed on the transition piece and the tensioning strands of the individual tension elements are pre-stressed and are held with the wedges. Since, in producing the stressing anchorage, first the inner end of the trumpet is bonded to the encasing tube and the outer end of the trumpet projects out of the structural part, this end being shortened to the necessary length only when the stressing anchorage has been fixed in position, the longitudinal tolerances in a transitional zone between the structural part and the pre-stressing tendons, or, respectively, between the end of the encasing tube and the outer wall of the structural part can be easily compensated. Shown in a variant embodiment is a correspondingly constructed electrically insulated stressing anchorage.

20 Claims, 5 Drawing Sheets

STRESSING ANCHORAGE FOR AT LEAST ONE TENSION ELEMENT RUNNING INSIDE AN ENCASING TUBE AND METHOD OF PRODUCING THE STRESSING ANCHORAGE

The present invention relates to a stressing anchorage for at least one tension element running inside an encasing tube and a method of producing the stressing anchorage.

The invention concerns in particular a stressing anchorage protected against corrosion and in a further embodiment a corrosion-protected and electrically insulated stressing anchorage.

BACKGROUND OF THE INVENTION

In the technology of prestressing buildings, prestressing with or without bonding is known. In the case of prestressing with bonding, the prestressing tendon, which can consist of several individual tension elements, running in an encasing tube, is, in tensioned state in the finished building, bonded to the concrete by means of a mortar mass introduced into the encasing tube. In the case of prestressing without bonding, the prestressing tendon, or each individual tension element thereof, is usually covered with a plastic sheath, and thereby not directly bonded to the concrete of the building. With correspondingly constructed anchorages such tension elements can be checked, post-tensioned, and if necessary removed or replaced at any time.

In the case of prestressing without bonding the tension elements of the prestressing tendon can be disposed internally in the building or externally. At least one of the ends of each tension element must be held thereby in a stressing anchorage. The other end of each tension element can also be held in a stressing anchorage or in a dead end anchorage.

The tension elements of the prestressing tendon are placed, as a rule, in an encasing tube, which for the most part can run inside the building or outside. Between the stressing anchorage and the end of the encasing tube turned toward the stressing anchorage there is a so-called transitional zone, in which during installation of the prestressing tendon the longitudinal tolerances between the prestressing tendon and the structural part are to be compensated, while maintaining the required corrosion protection and/or the required amount of electrical insulation between the prestressing tendon and the structural part. In the case of a prestressing tendon whose one end is constructed as a rock anchor or an earth anchor, or in the case of a prestressing tendon whose one end terminates in a dead end anchorage, there is a transitional zone at the stressing anchorage only.

The transitional zone between the stressing anchorage and the end of the encasing tube is usually bridged with a so-called trumpet. The trumpet is usually pushed from the outside through the opening of a bearing plate of the stressing anchorage, a flange being provided on the outer end of the trumpet which comes to rest on a stopping face of the bearing plate. In introducing the trumpet through the opening of the bearing plate, the inner end of the trumpet is either pushed over the encasing tube end or comes to lie in the area of the encasing tube end. In the first case, a sealing means is foreseen to achieve the required sealing of the two overlapping ends between the outer wall of the encasing tube and the inner wall of the trumpet. In the second case, a sleeve is fitted over the inner end of the trumpet and the adjacent end of the encasing tube, with which the two ends are joined together tightly. Making such seals is time consuming, and inspections of their tightness not easy. Encasing tubes out of round or having buckles could be the reason for this.

An embodiment of a corrosion-protected stressing anchorage of the type described, in which the trumpet is made of metal and is connected to the encasing tube by means of a sleeve is disclosed in DE 37 34 954. An embodiment in which the inner end of the trumpet is pushed over the encasing tube end, at least the trumpet being made of metal, is shown in AT 388 211.

Furthermore experience with earth and rock anchors has shown that the prestressing tendon is insufficiently protected against stray electrical currents or leakage current. Such currents, upon entering or respectively escaping from the prestressing tendon, can cause electrochemical reactions, such as, for example, a hydrogen embrittlement in the case of entering current and an anodic metal dissolution in the case of escaping current. Residual moisture in the concrete of the structural part is responsible for the entry or respectively the escape of such currents into or out of the prestressing tendon. With the invention described in previously mentioned document, DE 37 34 954, one attempted to achieve sufficient electrical insulation between the strands of the individual tension elements and the concrete structural part by filling the hollow spaces turned toward the stressing anchorage with grease in the transitional zone. This grease protects the strands of the individual tension elements against corrosion, the strands having been freed from their plastic sheaths at this place.

Another solution for achieving an electrically insulated stressing anchorage is shown in the documents U.S. Pat. No. 4,348,844 and U.S. Pat. No. 4,719,658. Proposed therein is to electrically insulate a tensioning wire placed in a plastic tube, or, respectively a tensioning strand sheathed in plastic, in the area of the stressing anchorage in that the stressing anchorage, especially the bearing plate and the load-bearing parts are enclosed with a sheath of electrically insulating material, which sheath is tightly connected to the said plastic tube or to the sheath of the tensioning strands. The outer area of this sheath is sealed with a cap-like cover.

With these measures corrosion of the tension elements and of the stressing anchorage is avoided to a large extent owing to the complete electrical insulation. Based on these solutions the anchor head is completely surrounded by an insulating cover, therefore also the surface of the anchor head which lies on the structural part to support the tension forces. Because of the great load which is transferred from the support surface through the insulation layer of the insulating sheath to the structural part, the danger arises that the insulating material, especially if it consists of plastic, could be damaged before or during setting in concrete or that through the armature force which has its effect through the insulating material, this material is pressed through, above all when it pushes against reinforcement elements. Through damage of this kind stray electrical current or leakage current can arise again. Then a corrosion process is created in places on the stressing anchorage, which makes for a high degree of danger.

Also foreseen in the last-mentioned embodiment is that the insulating cover which surrounds the stressing anchorage is designed in such a way that in order to compensate longitudinal tolerances it has an area which projects over the plastic tube or plastic sheath, respectively, through which the tensioning wire or strand runs. Producing a flawless sealing of this overlapping area between the insulating cover and the plastic tube of the tensioning wire or, respectively, the plastic sheath of the tensioning strand to achieve good electrical insulation is not completely unproblematical since such sealing can only be checked with difficulty. This applies for example when the plastic tube in which the tensioning wire is located is provided with dents or when the cross-section of the tensioning strand with the plastic sheath is not completely circular.

SUMMARY OF THE INVENTION

It is the object of the present invention to create a stressing anchorage with which optimal corrosion protection is achieved in a simple way for the tension elements in the anchorage area without the aforementioned problems arising thereby.

This object is attained with a stressing anchorage having the features cited in the device claims. The stressing anchorage according to the invention is produced according to the method disclosed in the process claims.

To prevent the trumpet from shifting impermissibly in the axial direction of the tension element, it has to be fixed on both ends. With prior art trumpets this takes place on one, outer end of the trumpet by means of a flange which lies on a bearing surface of the bearing plate or of the structural part, and on the other inner end of the trumpet by means of a connection provided with the encasing tube, the position of this connection point relative to the end of the encasing tube being dependent upon the observance of the tolerances of the structural part, and is determined after fitting of the bearing plate of the stressing anchorage. With the stressing anchorage design according to the present invention it is possible to connect the inner end of the trumpet with the end of the encasing tube at an optimal place before setting up the parts of the anchorage or possibly before insertion of the tension elements in the encasing tube. Compensation of the longitudinal tolerances of the transitional zone takes place by means of a shortening of the trumpet on its outer end projecting out of the structural part. The cutback outer end of the trumpet is fixed in the bearing plate by bending the said end in radial direction when introducing the frustoconical projection of a transitional piece into the opening of the bearing plate, the opening having an outwardly extending cone.

The trumpets and the encasing tube are made preferably of plastic, serving the purpose of corrosion protection which is as optimal as possible. High-pressure polyethylene (HP-PE) is preferred. In this case the inner end of the trumpet and the end of the encasing tube projecting to the transitional zone of the structural part can be welded together. The weld can be created by means of butt welding or can be achieved by putting on a so-called welding sleeve. So that the enlargement of the outer end of the trumpet progressing in radial direction can be achieved without cracks, heating of the plastic before insertion of the frustoconical projection is recommended.

In order to exclude as far as possible the possibility that the outer end of the trumpet recedes it is an advantage when either the surface area of the frustoconical projection which comes into contact with the inner wall of the trumpet end is roughened or structured, preferably provided with an encircling toothing. For example, this could be a sawtooth profile, the individual teeth forming an encircling ring of teeth which runs concentrically to the longitudinal axis of the stressing anchorage. The teeth are pressed into the plastic of the outer trumpet end in the finished stressing anchorage.

In a way similar to that just described, instead of the frustoconical surface area, or in addition thereto, the area of the outwardly extending cone of the bearing plate could be constructed with an encircling toothing. In a preferred embodiment this has been realized in that the said conical area in the opening of the bearing plate is formed by an insert ring which is inserted in an extension of the opening.

To produce an electrically insulated stressing anchorage the insert ring can be made out of plastic. In this case a plate of an electrically insulating material is disposed between the bearing plate and the annular surface of the transition piece with the frustoconical projection. This plate must be made of a material possessing great compressive resistance. A plate made of the material known by the trade name "Cevolit", a laminated plastic, has proved very suitable.

In a further construction a smaller metal insert ring can be inserted into the insert ring of plastic, the inner surface of the smaller metal insert ring forming at least a part of the conical area of the opening of the bearing plate and being provided with a toothing for additional fastening of the outer end of the trumpet. Instead of the said toothing the corresponding surface area could be just roughened or structured in some other way or profiled to achieve improved fixing of the outer end of the trumpet.

Part of the bearing plate, the transition piece and the anchor head of the stressing anchorage according to the invention are covered after tensioning of the tension elements with a cap preferably of an electrically insulating material. The hollow space inside the cap and inside the parts of the stressing anchorage is filled preferably with a grease which inhibits corrosion.

Used to advantage as the tension elements are so-called monostrands. With this design the tensioning strands are sheathed in plastic, in particular polyethylene. The interim spaces between the tensioning strands and the plastic sheath are filled with grease. Thus the tensioning strands remain movable longitudinally with respect to the structural part for post-tensioning or for replacement. This also applies when the hollow space between the plastic sheaths of the monostrands and the encasing tube is not filled with grease, but with an injected cement mortar capable of precipitation hardening.

BRIEF DESCRIPTION OF THE DRAWINGS

Some preferred embodiments of the invention will now be described in more detail, with reference to the figures in which.

DETAILED DESCRIPTION OF THE INVENTION

Figure 1:
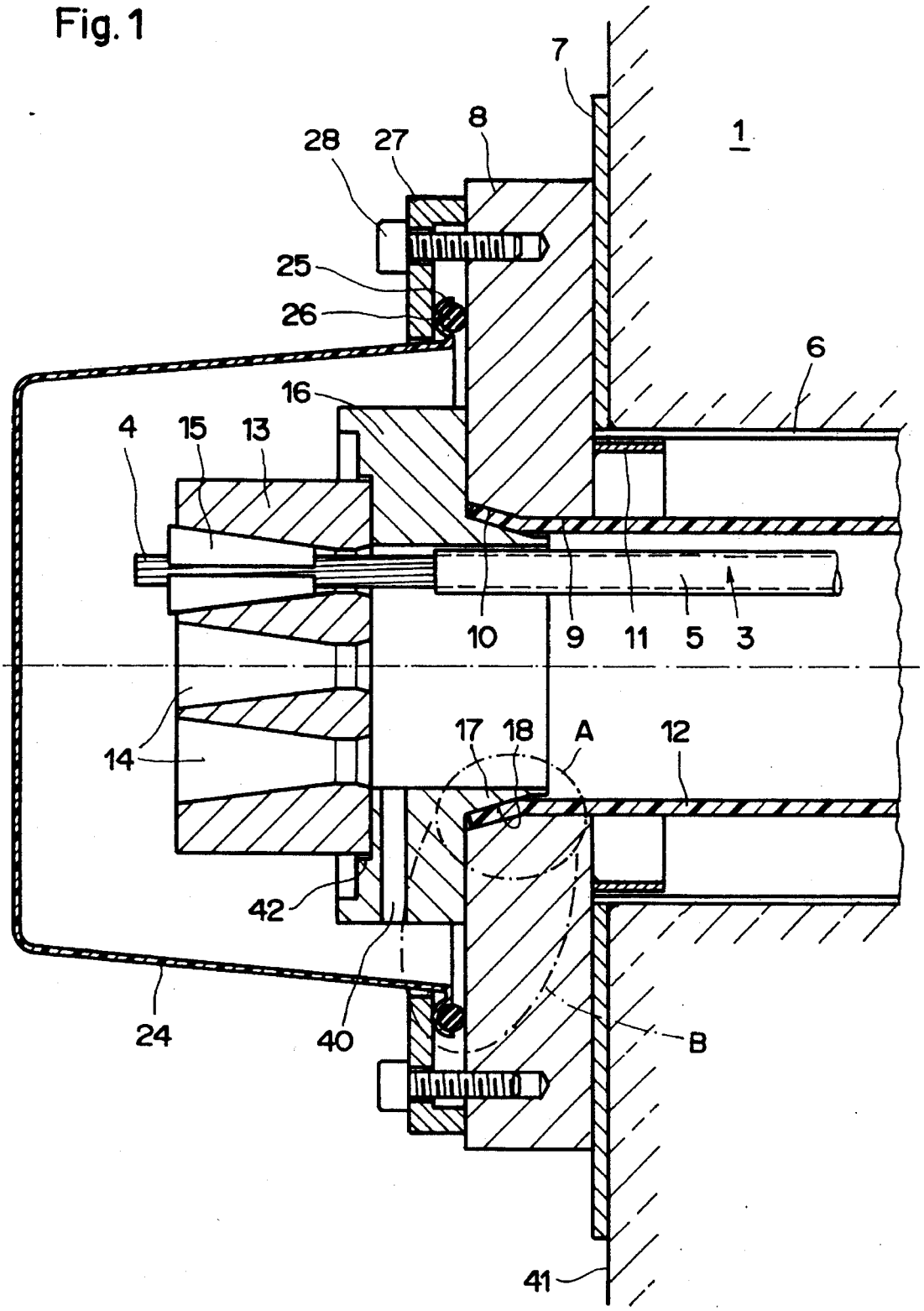
FIG. 1 is a longitudinal section through an embodiment of the stressing anchorage according to the invention.

In FIG. 1, the numeral 1 designates a structural part which has an outer wall 41 and in which a hole at least in the area of the outer wall is lined with an admission pipe 6 on which a flange 7 is provided on the end turned toward outer wall 41, which flange leans against the said outer wall. Admission pipe 6 and flange 7 are made preferably of steel and are welded together. Pressing against flange 7 is a bearing plate 8, preferably of steel, which has a continuous axial opening 9 of preferably circular cross-section. Fixed, preferably welded, on the face of the bearing plate 8 turned toward flange 7, concentrically to the opening, is a pipe piece 11. The pipe piece 11, which extends to the outer area of admission pipe 6, serves to center the bearing plate 8 on top of the admission pipe 6.

The opening 9 in the bearing plate 8 has in at least a portion of its axial length an outwardly extending cone 10 on the side turned away from the structural part.

Figure 6:
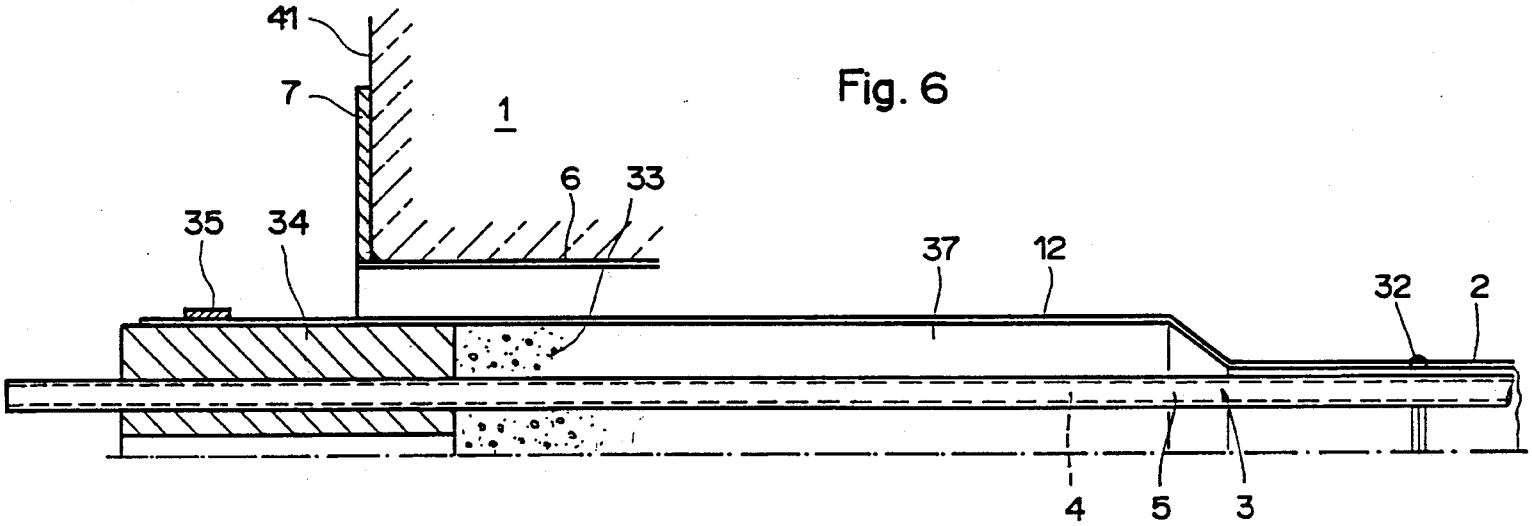
FIGS. 6, 7 and 8 show individual steps of the method for producing the stressing anchorage according to the invention.
Figure 7:
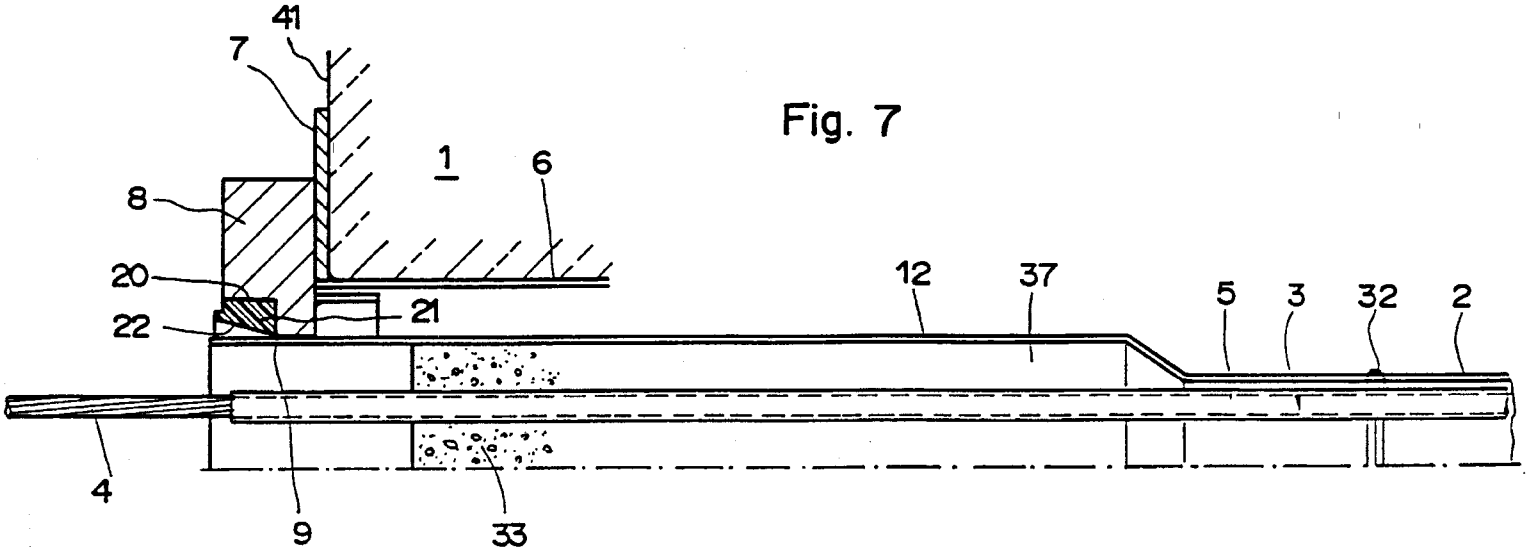
Figure 8:
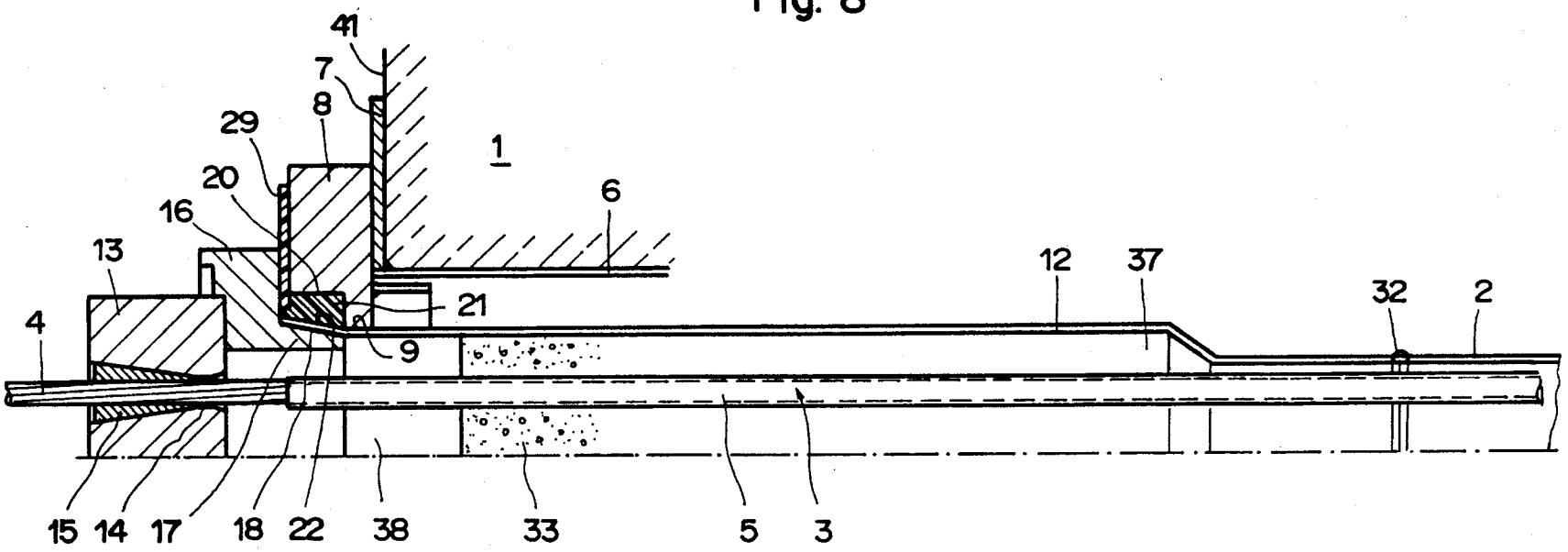

As can be seen from FIGS. 6, 7 and 8, an encasing tube 2 is inserted in structural part 1, which can run completely within or partly inside and partly outside the structural part. The end of the encasing tube shown in the figures projects into the vicinity of the one outer wall 41 of the structural part 1. Designated essentially as the transitional zone from the prestressing tendon to the stressing anchorage is the area between the said end of the encasing tube 2 and the outer wall 41 of the structural part 1. The length of this transitional zone can vary within the structural tolerances.

Adjoining the said end of encasing tube 2 is a trumpet 12, extending over the transitional zone to at least the opening of the bearing plate 8. The inner end of the trumpet turned toward encasing tube 2 is connected to the encasing tube. Since in the embodiment shown both the encasing tube and the trumpet are made of plastic—high-pressure polyethylene HP-PE has stood up to the test—the two said ends are preferably welded together. A weld 32 can be made by means of butt welding prior to inserting the tension elements 3 of the prestressing tendon. Instead of butt welding, an electrical welding sleeve could be used; in this case the welding together of the two ends could also take place after insertion of the tension elements 3.

Coming back to FIG. 1, it can be seen that the outer end of the trumpet in the embodiment example shown projects through opening 9 of the bearing plate and ends essentially flush with the face of the bearing plate 8 turned away from the structural part.

Designated 13 is an anchor head, which is usually made of steel and which has one or more continuous bores, depending upon the number of tension elements 3 of the tension member; the bores are designed conically in the conventional way for accepting multipart wedges 15 in each case. Each tension element 3 of the tension member is led through one of the continuous bores 14 and ends protruding on the side of the anchor head turned away from the structural part. In the embodiment example shown, the sole tension element 3 depicted is designed as a so-called monostrand. This monostrand comprises a tensioning strand 4, which is greased and is surrounded by a plastic sheath 5, preferably of polyethylene. The tensioning strand 4 of each tension member 3 is freed of its plastic sheath in its end area before insertion in the anchor head. In the embodiment shown the plastic sheath 5 of the tension element 3 terminates essentially in the area of the face of bearing plate 8 turned away form the structural part. Provided between the face of anchor head 13 turned toward structural part 1 and the face of bearing plate 8 turned away from the structural part is a metal transition piece 16, preferably annular. The transition piece 16 has centered a continuous bore, whose diameter is so big that none of the continuous openings 14 of anchor head 13 are covered up by the transitional piece. On the side turned toward the anchor head 13, transition piece 16 has a indentation 42 to center the anchor head 13. On the side turned toward from the bearing plate 8, the transition piece has a projection 17 whose surface area is constructed as a truncated cone 18. The projection projects into the opening 9 of bearing plate 8 and goes inside the outer end area of trumpet 12.

Formed in the opening 9 of bearing plate 8 between the outer frustoconical surface of projection 17 and the cone 10 is an annular gap through which the outer end area of trumpet 12 is extended conically in radial direction. The outer end area of trumpet 12 gets this extension when transition piece 16 and anchor head 13 are put on bearing plate 8, especially during prestressing of tension element 3. In the prestressed state the outer end of trumpet 12 is firmly clamped between the truncated cone 18 of projection 17 and the cone 10.

Transition piece 16 and anchor head 13 are covered with cap 24 of metal or preferably of plastic. Cap 24 is held on bearing plate 8. It has moreover an encircling sealing-acceptance flange 25 projecting radially outward on its end turned toward bearing plate 8. This flange 25 has an encircling groove into which a sealing ring 26 of an elastic material is inserted. Cap 24 with sealing ring 26 is pressed against the face of bearing plate 8 turned away from the structural part. In addition several clamps 27 are foreseen, for example distributed over the circumference of the sealing-acceptance flange 25 with which pressure is applied on the sealing-acceptance flange 25 against bearing plate 8. This pressing pressure is generated by means of screws 28, which penetrate the clamps 27 and project into tapped holes which are provided in the bearing plate 8.

Figure 2:
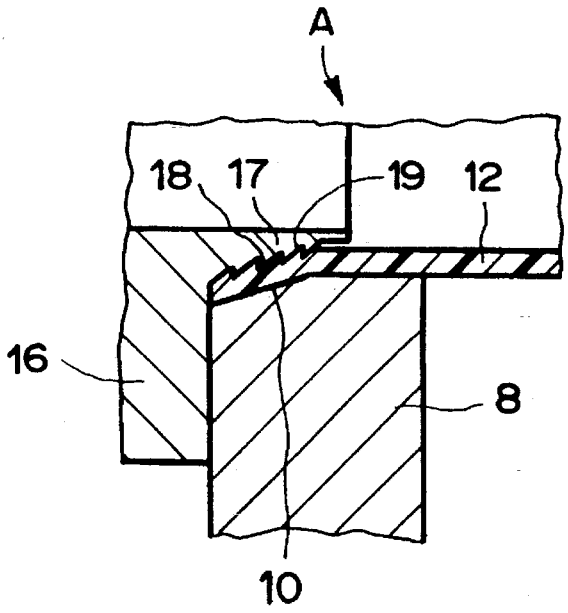
FIGS. 2 and 3 are each a variant embodiment presented as an enlarged cutout of the area A of FIG. 1, marked in FIG. 1 with a line of dots and dashes.
Figure 3:
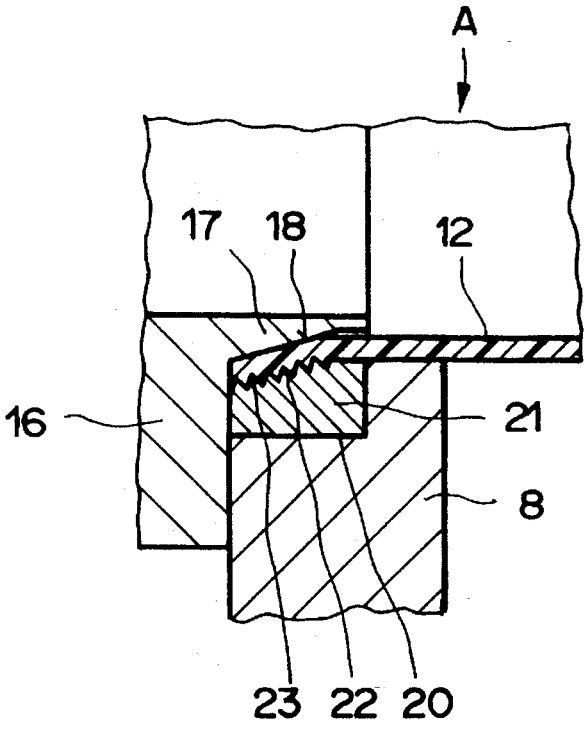

Presented enlarged in each of the FIGS. 2 and 3 is the cutout designated A in FIG. 1 and marked in FIG. 1 with a line of dots and dashes. Shown in FIG. 2, as a variant embodiment, is that the frustoconical surface area 18 of projection 17 of transition piece 16 could be provided with a toothing 19 to hold even more firmly the outer end of the trumpet. With the pressing of projection 17 into the opening of the bearing plate 8 during tensioning of the tension elements, the outer end area of trumpet 12 is not only pressed against cone 10, but the individual teeth of the toothing 19 are also pressed into the inner surface area of trumpet 12. Shown in FIG. 2 is a preferred sawtooth-shaped toothing. The teeth form thereby encircling ribs on the frustoconical surface area 18 of projection 17. A similar effect could be achieved if the surface area of the truncated cone 18 were only roughened in another way or given another kind of profile or structure than that shown.

The toothing serving to additionally fasten the outer end of trumpet 12 could also be provided in the conical area of the opening of the bearing plate, as shown in FIG. 3. Advantageous would be to provide, additionally, an area of the opening of bearing plate 8 turned toward transition piece 16 with a annular extension 20 and to insert an insert ring therein. This insert ring would have a cone 22 on its inner surface area, which would be provided with a toothing 23. The teeth would form thereby encircling channels or ribs, respectively, which extend in rows over the axial length of cone 22. As has already been said, other means instead of the toothing could be foreseen serving to additionally fasten the outer end of trumpet 12. It would also be possible to provide both the cone 10, 22 of the bearing plate and the truncated cone 18 of the projection 17 with such means.

Figure 4:
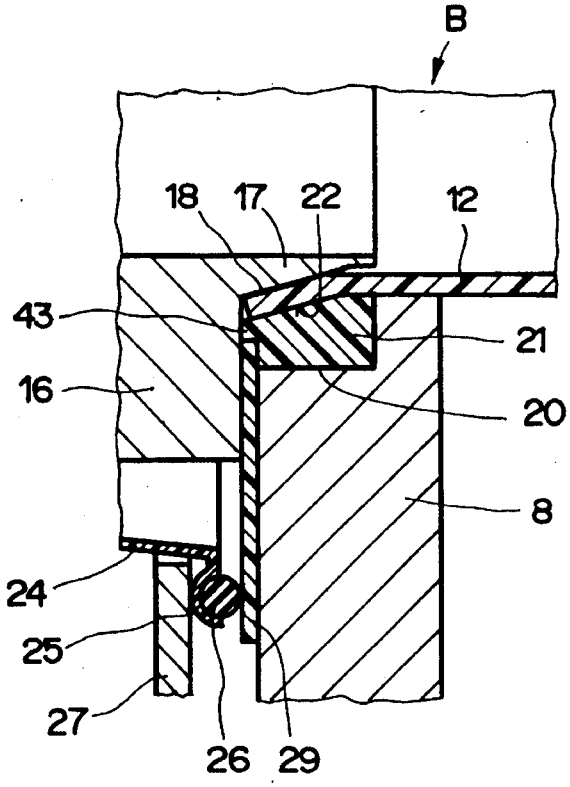
FIGS. 4 and 5 are each a further variant embodiment presented as an enlarged cutout of the area B of FIG. 1, marked in FIG. 1 with a line of dots and dashes.
Figure 5:
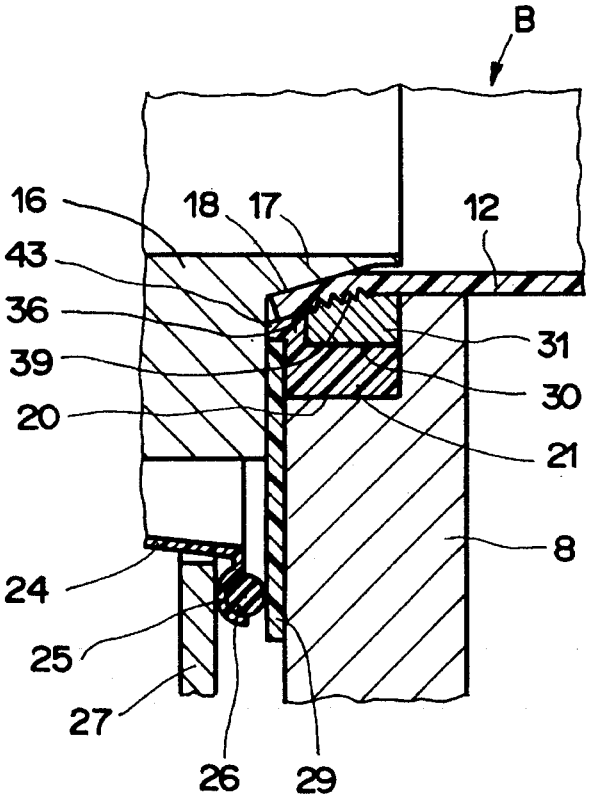

Shown in FIGS. 4 and 5 is how in a further embodiment of the invention an electrically insulated stressing anchorage can be made. FIGS. 4 and 5 show thereby variants of an area designated B in FIG. 1 and outlined in FIG. 1 with dots and dashes; this area is depicted enlarged.

In FIG. 4 a plate 29 of an electrically insulating material is placed between bearing plate 8 and transition piece 16, both of which are made of metal, preferably steel. The insert ring 21, which is disposed in the annular extension 20 of the opening of bearing plate 8, is also made of an electrically insulating material in this case. In that the outer end of trumpet 12 is pressed by the truncated cone 18 of projection 17 on the conically designed area of the inner surface of the insulating insert ring 21, an electrically insulated crossover from bearing plate 8 to transition piece 16 is created through the trumpet 12, the insert ring 21 and the plate 29. It is advantageous thereby if the insert ring 21 is made out of an elastic material and is a little overdimensioned in an unstressed state. In this way the electrical insulation between the bearing plate 8 and the transition piece 16 can be improved. The electrically insulating plate 29, which is designed annular in the example shown, extends radially outwardly far enough that it projects at least to under the sealing ring 26 of the cap 24, here made of plastic. Thus, with the exception of the bearing plate 8, all the parts of the stressing anchorage are surrounded by electrically insulating parts.

When the insert ring 21 is made of an electrically insulating material it is still possible to strengthen the clamping effect on the outer end of the trumpet 12 between the truncated cone 18 of projection 17 and the conical area of the opening of bearing plate 8 on the side of the conical area. For this purpose a recess 30 is foreseen in insert ring 21 which recess extends in axial direction from the inner face of insert ring 21 turned away from transition piece 16 to approximately the middle of this insert ring. Inserted into the recess 30 is a further insert ring 31, made of a hard material, preferably steel. The inwardly projecting frontal surface of this further insert ring 31 abuts on the annular surface of extension 20 in the opening of bearing plate 8. The inner surface area of further insert ring 31 is provided with a cone 36 extending in outward direction and has a toothing 39, which could also be designed according to the variations previously described, however. To center the annular plate 29, the electrically insulating insert ring 21 is preferably provided on the face turned away from the bearing plate 8 with an encircling centering shoulder 43 projecting outwardly. In a further design variation, construction of the plate 29 and the insert ring 21 in one piece could be foreseen.

FIGS. 6, 7 and 8 show individual steps of the method to produce the stressing anchorage according to the invention. Shown in FIG. 6 is that the inner end of trumpet 12 projecting into the structural part 1 is welded together with an end of encasing tube 2, both being made of plastic. The weld is designated 32. As already mentioned, it could be made by butt welding. The trumpet 12 is designed to be long enough to project with its outer end out of the structural part. The tension elements 3, only one of which is illustrated in the figures, shown as a monostrand 4, 5, are then inserted into the encasing tube 2 and into the trumpet 12. One end of the tension elements 3 juts out of the outer end of trumpet 12. A sealing piece 34, provided with longitudinal openings corresponding to the diameters of the tension elements 3, is led over the tension elements and is pushed into the trumpet, the inner end of the sealing piece 34 thereby overlapping the outer wall 41 of the structural part 1. The sealing piece 34 is clamped tight with a clamp fitting 35, which is placed around the projecting part of trumpet 12. The hollow space between the encasing tube 2 of the trumpet 12 and the individual tension elements 3 is now filled with a grouting mass 33. A mortar mass capable of precipitation hardening can be used for this purpose. It would also be possible, however, to fill the said hollow space with grease.

After grouting the sealing piece 34 can be removed after loosening of the clamp fitting 35 and can be reused.

Of course it is also possible to weld the inner end of trumpet 12 with the said end of the encasing tube after the tension elements 3 have been inserted in the encasing tube. Then instead of the aforementioned butt welding, an electrical welding sleeve would be used which can be placed around the said end.

Following the aforementioned grouting, the bearing plate 8 is now fitted, as seen in FIG. 7. In the embodiment shown, the bearing plate has an insert ring 21 made of an electrically insulating material in its opening 9 on the side turned away from the structural part 1.

The part of the trumpet jutting out of the structural part is now shortened in such a way that the outer end of trumpet 12 is practically flush with the face of bearing plate 8 turned away from the structural part. The end areas of tension elements 3 jutting out of the structural part 1 are freed of sheathing until approximately the face of the bearing plate 8 just mentioned. The strand of each tension element is bare from this point on.

For producing an electrically insulated stressing anchorage the electrically insulating plate 29 is now placed on the free face of bearing plate 8, the transition piece 16 with its outermost end of projection 17 pushed as far as possible into the outer end of the trumpet 12, not yet widened radially outward, and the anchor head 13 is put on with the clamps 15. In tensioning the tension elements 3, the outer end of the trumpet 12, as already explained, is bent outwardly in radial direction, and is clamped firmly between the cone 22 of the insert ring 21 and the truncated cone 18 of the projection 17. As has already been mentioned, to avoid cracks in the trumpet during this step, the outer end of the trumpet is preferably heated.

As shown in FIG. 1, a corrosion-protected stressing anchorage can be produced which is not especially electrically insulated if plate 29 is omitted and an insert ring 21 is used which is not made of an electrically insulating material, but is made of metal, for example.

After the tensioning step, the remaining hollow space 38 between the grouting mass 33 and the anchor head 13 is filled with a grease which protects against corrosion. For this purpose a filling hole 40 (FIG. 1) is foreseen running radially in transition piece 16.

It should be mentioned that for reasons of clarity, grouting and/or ventilation lines have not been depicted. State-of-the-art lines of this kind can be put in everywhere they are necessary by anyone skilled in the art.

What is claimed is:

1. Stressing anchorage for at least one tension element running inside an encasing tube having first and second ends, with a bearing plate supported against a part of a building structure, said bearing plate having a continuous opening, with a trumpet having an inner and an outer end, the inner end essentially joining said first end of the encasing tube and being connected to it and the outer end extending at least into said continuous opening of said bearing plate, with an anchor head having at least one continuous bore, wherein said at least one tension element is anchored with a wedge in said at least one continuous bore of said anchor head, said anchor head being supported against the bearing plate through an annular transition piece, with at least one area of said continuous opening of said bearing plate turned toward the anchor head having a cone opening toward the anchor head, and the outer end of the trumpet projecting into said at least area of said continuous opening, wherein said transition piece comprises a projection leading into said continuous opening, with the surface area of said projection forming a truncated cone, and the surface area of said truncated cone running essentially parallel to the surface area of said cone opening, and wherein said outer end area of said trumpet is pressed upon said cone opening of said bearing plate by means of the truncated cone of the projection, said outer end being held in an annular gap between said truncated cone and said cone opening.

2. Stressing anchorage according to claim 1, wherein the trumpet and the encasing tube are made of plastic, preferably high pressure polyethylene, and wherein the inner end of the trumpet is welded to the encasing tube.

3. Stressing anchorage according to claim 1, wherein the surface area of the truncated cone is at least partially roughened.

4. Stressing anchorage according to claim 1, wherein the surface area of the truncated cone is at least partially structured.

5. Stressing anchorage according to claim 3, wherein the surface area of the truncated cone is provided with an encircling toothed profile.

6. Stressing anchorage according to claim 1, wherein said continuous opening of the bearing plate has an annular extension in an area turned toward the anchor head, wherein an insert ring is inserted into the extension and wherein the inner surface area of the insert ring is provided with a cone, the greater diameter of which is directed outwardly.

7. Stressing anchorage according to claim 6, wherein the insert ring is made of metal, preferably steel, and wherein the surface area of the cone of said insert ring is at least partially roughened.

8. Stressing anchorage according to claim 7, wherein the surface area of the cone of said insert ring is at least partially structured.

9. Stressing anchorage according to claim 7, wherein the surface area of the cone of said insert ring is provided with an encircling toothed profile.

10. Stressing anchorage according to claim 6, wherein the insert ring is made of an electrically insulating material, which is preferably permanently elastic, and wherein an electrically insulating plate is disposed between the facing frontal surfaces of the bearing plate and the transition piece.

11. Stressing anchorage according to claim 10, wherein the insulating plate and the insert ring are made in one piece.

12. Stressing anchorage according to claim 10, wherein there is a recess in the insert ring into which a further metallic insert ring is inserted, the inner surface area of the further insert ring having a cone and being at least partially roughened.

13. Stressing anchorage according to claim 12, wherein the inner surface area of the further insert ring is at least partially structured.

14. Stressing anchorage according to claim 12, wherein the inner surface area of the further insert ring is provided with an encircling toothed profile.

15. Stressing anchorage according to claim 10, wherein there is a cap surrounding the anchor head which is made preferably of an electrically insulating material and which is held on the projecting insulating plate between the bearing plate and the transition piece.

16. Stressing anchorage according to claim 1, wherein the at least one tension element is a monostrand.

17. Method of fabricating a stressing anchorage for at least one tension element comprising the steps of running said at least one tension element inside an encasing tube having first and second ends, providing a bearing plate having a continuous opening, with the bearing plate supported against a structural part, and having a trumpet with an inner and an outer end, wherein the inner end of the trumpet is bonded to said first end of the encasing tube, and the outer end of said trumpet projecting out of the structural part, wherein one end of said at least one tension element is pulled into the encasing tube and into the trumpet to project out of the outer end of the trumpet, wherein the bearing plate is placed on the structural part with a face of said bearing plate turned away from said structural part, with said outer end of the trumpet penetrating said continuous opening, wherein the projecting outer end of the trumpet is shortened so that it is essentially flush with said face of the bearing plate turned away from the structural part, and providing a transition piece having a frustoconical projection, which is placed along with an anchor head on the bearing plate, with said continuous opening of the bearing plate having a cone corresponding to the frustoconical projection, wherein said at least one tension element is positioned through a continuous bore in said anchor head and anchored therewith, and wherein stressing of the tension element is performed through the pressing of said projection of the transition piece into the cone of said continuous opening of the bearing plate such that the outer end of the trumpet is bent up and is held in an annular gap between said frustoconical projection and the said cone of said bearing plate.

18. Method according to claim 17, wherein the hollow space between the at least one tension element and the encasing tube as well as of the trumpet are filled with a injected mass, preferably cement mortar or grease until close to the outer wall of the structural part, and wherein following stressing of the at least one tension element the rest of the hollow space between the grouting mass and the anchor head is filled with a formable anticorrosive mass, preferably grease.

19. Method according to claim 17, wherein the at least one tension element has a strand sheathed in plastic, wherein the plastic sheath of the tension element is removed starting from its end until essentially the level of the shortened outer end of the trumpet.

20. Stressing anchorage according to claim 4, wherein the surface area of the truncated cone is provided with an encircling toothed profile.

* * * * *